United States Patent [19]

Forget nee Lamy et al.

[11] 4,223,668

[45] Sep. 23, 1980

[54] FACE MASSAGER

[76] Inventors: Noëlla Forget nee Lamy; Maurice Forget, both of 5237 Louis Veuillot St., Montreal, Canada, H1M 2N4

[21] Appl. No.: 60,159

[22] Filed: Jul. 24, 1979

[51] Int. Cl.[3] ..... A61H 9/00

[52] U.S. Cl. ..... 128/66; 128/366; 128/368

[58] Field of Search ..... 128/65, 66, 368, 400, 128/402, 256; 4/145

[56] References Cited

U.S. PATENT DOCUMENTS

| | | | |
|---|---|---|---|
| 2,682,868 | 7/1954 | Fortin | 128/66 |
| 2,699,773 | 1/1955 | Nemeth | 128/66 |
| 3,088,459 | 5/1963 | Rabinoff | 128/66 |
| 3,766,911 | 10/1973 | Green | 128/66 |
| 3,768,483 | 10/1973 | Kusunoki | 128/368 |

FOREIGN PATENT DOCUMENTS

| | | | |
|---|---|---|---|
| 158869 | 9/1954 | Australia | 128/206.24 |
| 130417 | 4/1902 | Fed. Rep. of Germany | 128/66 |

*Primary Examiner*—Lawrence W. Trapp

[57] ABSTRACT

A cosmetic mask in the shape of a cone and made of transparent slightly flexible material, adapted to fit in watertight engagement around the face of a user; a nose hole is provided, having an opening in the top surface of the mask and a bulbous portion at its lower end into which the nose of the user is inserted. A hose, adapted to be attached to a standard water tap, has a rigid inner end projecting a short distance inside the mask and includes thereon rotatably mounted radial branches which rotate under the pressure of water flowing through them, spraying water inside the mask towards the face of the user. Each branch is provided with a rotatably mounted nozzle which can be positioned to adjust the direction of the spray inside the mask. A drainage means is provided at the bottom surface of the mask.

4 Claims, 4 Drawing Figures

FACE MASSAGER

FIELD OF THE INVENTION

This invention relates to cosmetic masks and, more particularly, to a mask which is applied to the face and is provided with means to massage the skin of the face.

BACKGROUND OF THE INVENTION

Cosmetic therapeutic masks are not unknown in the art, since it has been found that the application of heat and/or hot fluid, such as water to the face, will decongest sinus cavities and passages and thoroughly cleanse the skin of the face by opening the pores. When such a mask is used in combination with a cosmetic deep skin cleanser, the results are very beneficial to the facial skin in that it becomes rejuvenated and acquires luminosity and even pizzaz. After the pores are opened and cleansed of oil and dirt, cold water may be applied the face through the mask to close them and, at the same time, massage the facial muscles, giving them better tone.

An example of such a facial mask is U.S. Pat. No. 3,088,549 showing a specially molded face-piece resembling a real human face and an elaborate circulating system, including a pump and reservoirs for the fluid. This cosmetic mask is not practical, since it is relatively expensive and is designed primarily for use in a beauty parlor. Also, a person using this mask would have some difficulty breathing, because the nose holes are small and removed from the nose of the user.

OBJECTS OF THE INVENTION

Accordingly, it is an object of the present invention to provide a face massager which avoids the above-mentioned disadvantages and is convenient to use.

It is another object of the present invention to provide a face massager which may be used anywhere there is a pressurized water supply.

It is still another object of the present invention to make provision for a face massager having means to circulate pressurized fluid inside the mask.

Yet another object of the present invention is to make provision for a face massager which is inexpensive to produce and easy to use.

SUMMARY OF THE INVENTION

The preferred embodiment of the face massager includes a cone-shaped mask, made of slightly flexible resilient material. The open end of the mask is provided with a flexible, compressible bead whereby the mask may be fitted in watertight engagement with the contour of any shape of face, whether it be oval, round, triangular or square. For breathing, while the mask is on the face, a nose-tube is provided, having a bulbous lower end into which the nose of the user is inseted and an upper end opening out on the top surface of the cone. The apex end of the cone is provided with a tube leading out of the mask and the inner end of the tube, i.e. the portion of the tube inside the mask, is equipped with angularly spaced radial pipes or jets which rotate while discharging water toward all parts of the face covered by the mask, whereby the skin of the face is bathed, cleansed and massaged.

An exit outlet for the water sprayed inside the mask is provided in the lower portion of the mask, generally below the chin of the user, so that the water flows out of the mask and into a sink, to the faucet of which the other end of the tube is connected for the water supply to the mask.

The above will be more clearly understood by referral to a preferred embodiment of the invention, illustrated by way of the accompanying drawings, in which:

BRIEF DESCRIPTION OF THE DRAWINGS

Like numerals refer to like elements throughout the drawings.

DETAILED DESCRIPTION OF THE INVENTION

Figure 1:
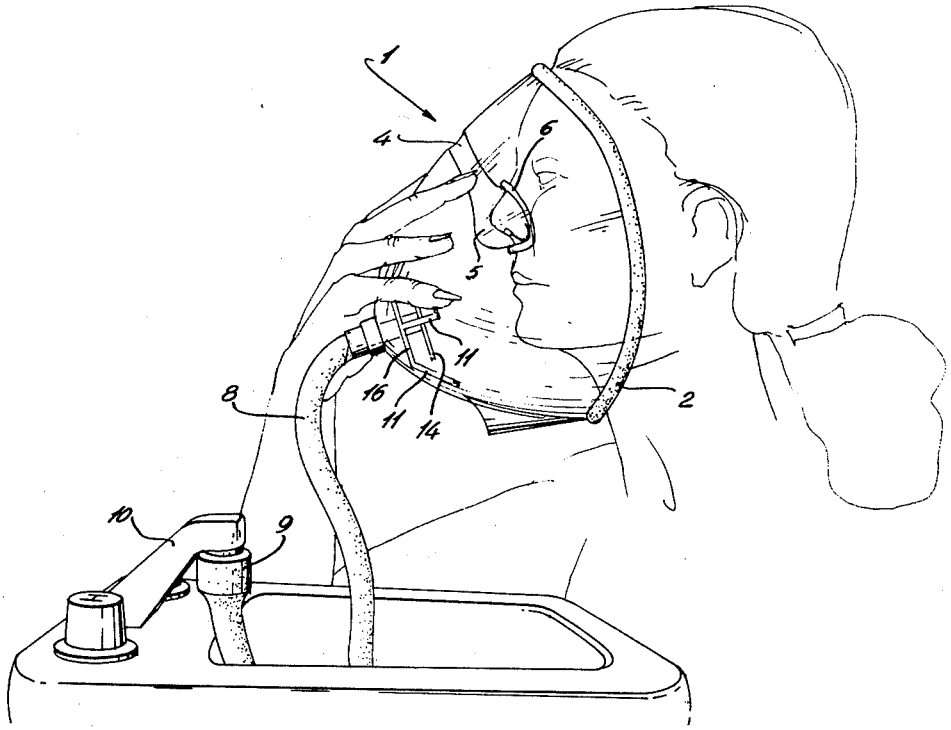
FIG. 1 is a perspective view of the mask in use by a person and showing the tube connected to a sink faucet.
Figure 2:
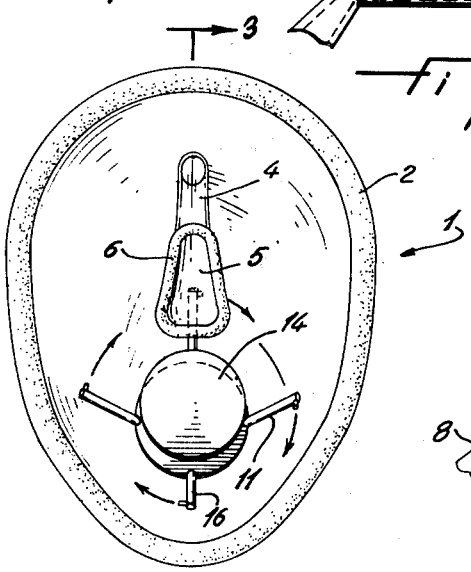
FIG. 2 is a rear end elevation of the mask.

The preferred embodiment of the invention includes a mask 1, made of slightly flexible preferably transparent material, such as plastic. As clearly shown in FIG. 1, the mask fits in waterproof engagement with the top of the forehead, down along the back of the checks and across the neck to expose within the mask the face and upper part of the neck of a user. Mask 1 is generally cone-shaped. The rear or open end of the mask 1 is provided at its edge with a flexible, compressible bead 2, for instance made of rubber. Passing through the center of this bead 2 is a flexible metallic wire element 3. Although FIG. 2 shows bead 2 conforming generally to a triangularly shaped face, it will be obvious that bead 2 and wire 3 can be flexed into a variety of shapes to conform exactly to the particular shape of the face of a person using the mask. Therefore, an advantage of the present invention is that anyone can use it and obtain a watertight engagement with his or her face.

A breathing means is provided in mask 1, consisting of a tube 4, preferably made of transparent plastic and opening out at the top face of the mask, secured to the top wall and downwardly extending therefrom. The lower end of tube 4 flares into a bulbous portion 5 having a lateral opening facing rearwardly of the mask and provided at its edge with a bead 6 which may have a wire element, similar to wire 3, passing through its center. Rubber bead 6 is flexible and compressible; it is adapted to fit in waterproof engagement around the contour of any shape of nose inserted within said lateral opening.

The apex or front end of mask 1 is provided with a hose 8, the outer end of which is provided in turn with an adapter 9, of any known type, which may be conveniently attached to a water faucet outlet tap 10.

Figure 4:
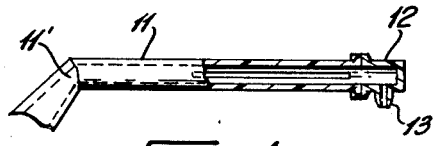
FIG. 4 is a partially sectioned side elevation of a discharge jet showing the nozzle at the outer end.

The inner end of hose 8 is attached to a rigid nipple 7 which extends through a hole at the apex of mask 1 into the interior of the mask for a short distance and is secured to the mask. A disc 14 is secured to the inner end of nipple 7 and retains on the latter a sleeve 15, which can rotate freely on nipple 7. A hollow disc 16 is fixed to sleeve 15 and is provided with four equally spaced-apart radial tubular branches 11 which project radially outwardly from the rotational axis of sleeve 15. These branches 11 are therefore rotatably mounted on the nipple 7 and are in communication with the interior of nipple 7 and hose 8 to be fed by water under pressure. For that purpose, nipple 7 has holes (not shown) registering with hollow disc 16. The outer ends of branches 11 are provided with jet members 12, each having a nozzle 13 directed perpendicularly away from the axis of its corresponding branch 11. Water under pressure issuing from nozzles 13 causes rotation of branches 11 about nipple 7, as in a lawn sprinkler. Each jet member 12 is removably fitted on the end of branch 11, as shown in FIG. 4, and can be adjustably rotated about the axis of branch 11. Thus, each nozzle 13 can be positioned in the plane of rotation of its corresponding branch to provide a fast rotation of the branch and less direct spray of water on the user's face, or it can be positioned at an angle to the plane of branch rotation to reduce the rotating speed of branches 11 and provide a more direct spray on the user's face, if so desired. As clearly shown in FIG. 3, the branches 11 are bent at 11 inwardly at a small angle to ensure free rotation inside the mask adjacent the apex of the latter. Water is sprated not only onto the user's face and forehead, but also under the chin and onto the upper portion of the neck.

Figure 3:
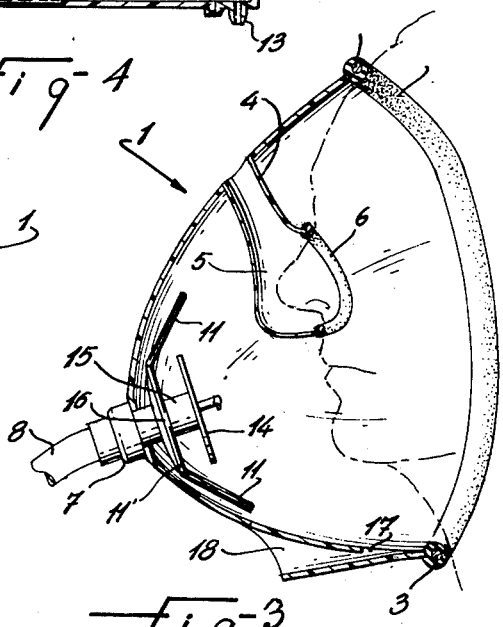
FIG. 3 is a sectional view taken along line 3—3 of FIG. 2 and showing a profile of a user in dashed outline.

A drainage means is also provided for the mask, consisting of a hole or slot 17, made in the bottom surface of the mask, as clearly shown in FIG. 3. Underlying this slot 17 is a forwardly inclined chute 18 which carries away the water into a sink, as suggested by FIG. 1, or any other suitable receptacle.

What we claim is:

1. A cosmetic mask comprising a slightly flexible mask adapted to be fitted around the face of a user and generally in the shape of a cone; the rear periphery of the cone being provided with a flexible and compresible bead for watertight engagement of the mask with the top of the forehead, down along the back of the cheeks and across the neck to expose within the mask the face and upper part of the neck of a user, further comprising a nose-tube secured to and downwardly depending from the top wall of said mask, opening out on the top surface of said mask and flaring out at its lower end into a bulbous portion provided with a rearwardly facing lateral opening into which the nose of a user is inserted; the periphery of said lateral opening being provided with a second and compressible, flexible bead; a nipple attached at the front end apex of said mask, extending a short distance inside the cone, a hose connected to said nipple and having means at its outer end for attachment to a standard water tap, a water-spraying assembly rotatably mounted on said nipple, communicating with said nipple and including at least one radial tubular branch having a transversely-directed nozzle at its outer end and adapted to revolve inside the mask under the action of water issuing from the nozzle to spray water rearwardly into the mask not only onto the user's face and forehead but also under the chin and onto the upper portion of the neck, and further comprising a drainage means in the bottom surface of said mask.

2. A cosmetic mask as claimed in claim 1, wherein there are several equally-spaced radial branches and each is bent rearwardly at a small angle.

3. A cosmetic mask as claimed in claim 2, wherein each said radial branch is provided at its outer end with a jet member carrying said nozzle, the jet member rotatable about the longitudinal axis of the related branch, such that each said nozzle may be positioned at an angle to the plane of rotation of its corresponding branch, whereby the rotational velocity of the said branches may be reduced and the direction of the water jet issuing from the nozzle may be varied.

4. A cosmetic mask as claimed in claim 1, wherein said drainage means consists of an opening in the lower surface of said mask adjacent said periphery and a forwardly-inclined chute underlying said opening.

* * * * *